US011623249B2

(12) United States Patent
Kato et al.

(10) Patent No.: US 11,623,249 B2
(45) Date of Patent: Apr. 11, 2023

(54) VIBRATING SCREEN

(71) Applicant: METSO BRASIL INDÚSTRIA E COMÉRCIO LTDA, Sorocaba (BR)

(72) Inventors: Sadao Kato, Sao Paulo (BR); Fausto Rezende, Jr., Belo Horizonte (BR); Ricardo Maerschner Ogawa, Sorocaba (BR)

(73) Assignee: METSO BRASIL INDÚSTRIA E COMÉRCIO LTDA, Sorocaba (BR)

( * ) Notice: Subject to any disclaimer, the term of this patent is extended or adjusted under 35 U.S.C. 154(b) by 0 days.

(21) Appl. No.: 16/771,991

(22) PCT Filed: Dec. 12, 2018

(86) PCT No.: PCT/BR2018/050457
§ 371 (c)(1),
(2) Date: Jun. 11, 2020

(87) PCT Pub. No.: WO2019/113666
PCT Pub. Date: Jun. 20, 2019

(65) Prior Publication Data

US 2020/0398311 A1 Dec. 24, 2020

(30) Foreign Application Priority Data

Dec. 12, 2017 (BR) ..... 10 2017 026766 0

(51) Int. Cl.
*B07B 1/38* (2006.01)
*B07B 1/28* (2006.01)
*B07B 1/44* (2006.01)

(52) U.S. Cl.
CPC ..... *B07B 1/284* (2013.01); *B07B 1/38* (2013.01); *B07B 1/44* (2013.01)

(58) Field of Classification Search
CPC ..... B07B 1/284; B07B 1/38; B07B 1/44; B07B 1/42; B07B 1/28; B07B 1/34; B07B 1/36; B07B 1/49; B07B 1/50
See application file for complete search history.

(56) References Cited

U.S. PATENT DOCUMENTS 2,200,724 A * 5/1940 Robins ..... B07B 1/284 74/87
2,312,477 A * 3/1943 Pollitz ..... B07B 1/284 74/61
2,828,014 A * 3/1958 Wantling ..... B07B 1/284 209/326

(Continued)

FOREIGN PATENT DOCUMENTS

BR PI1105435 A2 10/2013
CN 2111143 U 7/1992

(Continued)

OTHER PUBLICATIONS

International Search Report for International Patent Application No. PCT/BR2018/050457 dated Feb. 26, 2019.

(Continued)

*Primary Examiner* — Patrick H Mackey
(74) *Attorney, Agent, or Firm* — Andrus Intellectual Property Law, LLP

(57) ABSTRACT

The vibrating screen have a screen deck, two sidewalls and a mechanical vibrator comprising two shafts, rotating at the same rotation and in opposite directions, each one of the end portions of each shaft carrying an eccentric weight and being supported on bearings which are supported in the sidewalls of the vibrating screen. The shafts have their end portions, adjacent to each other, supported on bearings mounted to a same bearing case fixed to beams, transversal and having opposite ends fixed to the sidewalls of the vibrating screen. Each end portion of a shaft carries an eccentric weight with a total mass different from that one of the eccentric weights of the end portions of the other shaft, said shafts rotating in (Continued)

determined phases, defining the inclination of the major axis of an elliptical movement imparted to the screen deck.

8 Claims, 5 Drawing Sheets

(56) References Cited

U.S. PATENT DOCUMENTS

| | | | | |
|---|---|---|---|---|
| 3,704,631 | A | 12/1972 | Marks | |
| 3,796,299 | A | 3/1974 | Musschoot | |
| 4,180,458 | A * | 12/1979 | Shahan | B07B 1/284 209/326 |
| 4,197,194 | A | 4/1980 | Read | |
| 4,255,254 | A * | 3/1981 | Faust | B06B 1/166 198/770 |
| 4,272,366 | A | 6/1981 | Dean et al. | |
| 4,340,469 | A | 7/1982 | Archer | |
| 4,632,751 | A * | 12/1986 | Johnson | B07B 1/42 74/61 |
| 5,051,171 | A | 9/1991 | Hukki | |
| 5,220,846 | A | 6/1993 | Niklewski | |
| 5,494,173 | A * | 2/1996 | Deister | B07B 1/42 209/326 |
| 6,349,834 | B1 | 2/2002 | Carr et al. | |
| 6,889,820 | B2 * | 5/2005 | Rubie | B07B 1/42 198/770 |
| 8,156,832 | B2 | 4/2012 | Niklewski | |
| 10,046,364 | B2 * | 8/2018 | Ashley | B06B 1/16 |
| 2004/0045877 | A1 | 3/2004 | Rubie et al. | |
| 2009/0026114 | A1 | 1/2009 | O'Keeffe et al. | |
| 2017/0333949 | A1 * | 11/2017 | Felton | B07B 1/36 |

FOREIGN PATENT DOCUMENTS

| | | | |
|---|---|---|---|
| CN | 1501845 | A | 6/2004 |
| CN | 2016699210 | U | 12/2010 |
| CN | 201711281 | U | 1/2011 |
| CN | 201735509 | U | 2/2011 |
| CN | 203265047 | U | 11/2013 |
| EA | 14306 | B1 | 10/2010 |
| EP | 1439139 | B1 | 11/2006 |
| EP | 2034437 | A1 | 3/2009 |
| FR | 59077 | E | 4/1954 |
| RU | 324 1 6 | U1 | 9/2003 |
| RU | 2440856 | C2 | 1/2012 |
| SU | 1284603 | A1 | 1/1987 |
| WO | 1996008301 | A1 | 3/1996 |
| WO | 1998016328 | A1 | 4/1998 |
| WO | 2007014444 | A1 | 2/2007 |

OTHER PUBLICATIONS

Written Opinion for International Patent Application No. PCT/BR2018/050457 dated Feb. 26, 2019.

Extended European Search Report for corresponding European Application No. 18888894.5 dated Sep. 3, 2021.

Search Report for corresponding Chilean Application No. 1570-2020 dated May 5, 2021.

Office Action and Search Report for corresponding Russian Application No. 2020121193 dated Mar. 30, 2022.

Office Action and Search Report for corresponding Chinese Patent Application No. 2018800799716, dated Jun. 6, 2022.

* cited by examiner

VIBRATING SCREEN

CROSS-REFERENCE TO RELATED APPLICATIONS

This application is the U.S. national stage application of International Application PCT/BR2018/050457, filed Dec. 12, 2018, which international application was published on Jun. 20, 2019, as International Publication WO 2019/113666 A1 in the Portuguese language. The International Application claims priority of Brazilian Patent Application No. 10 2017 026766 0 filed Dec. 12, 2017.

FIELD OF THE INVENTION

The present invention relates to a mechanical vibrator with a bearing case mechanism to be mounted on vibrating screens for separating bulk material to vibrate a screen deck of at least one screen element, the mechanical vibrator being of the type which comprises a pair of bearing cases supported by the structural sidewalls of the vibrating screen and supporting the opposite end portions of rotating shafts which are transversal to the longitudinal axis of the vibrating screen, said end portions of the shafts carrying eccentric weights.

BACKGROUND OF THE INVENTION

The process of separating bulk grains or particles of different sizes in machines or vibrating screens comprises the passage of the bulk material along the screen deck of a screen element which is vibrated so that, with the displacement of the bulk material, the smaller particles pass through the holes of the screen deck, to be separately released from the larger particles being displaced over the screen deck.

The vibratory movement imparted to the vibrating screen and to its separation screen deck is intended to cause the bulk material to be moved over the screen deck and also an upward thrust to the translational material to prevent that a particle, not passing through a hole in the screen deck, remains permanently stuck in a screen hole, obstructing the passage of other smaller particles through the screen hole.

In one of the known vibrating screen constructions, the screen deck is displaced in reciprocating linear movement, in a forward and upward inclined direction, relative to the screen deck, this movement being obtained by the provision of two transversal shafts, with their end portions rotatively supported on respective pairs of bearings, each pair being housed in a respective bearing case which is in turn secured through a respective sidewall of the vibrating screen.

Each end portion of each shaft carries at least one eccentric weight, the shafts being rotated in opposite directions and with the same frequency and in determined phases, which define the inclination of the direction of reciprocating linear movement, relative to the plane of the screen deck.

The efficiency of separation of a vibrating screen depends on several factors, among which can be mentioned the thickness of the layer of bulk material being displaced on the screen deck and the residence time of the bulk material on said screen deck. In addition to the above two factors, it should be also considered the maintenance of the holes of the screen deck in a non-obstructed condition.

Thus, it is desirable that the mat of bulk material, being transported over the screen deck, be moved linearly forward and also upward, intermittently and at a predetermined frequency, to better revolve the bulk material and still to move upwardly and outwardly from the holes, the particles that are clogging the holes.

Considering the factors mentioned above and relevant to the vibratory screening of bulk material, another known vibratory sieve construction was proposed, according to which the screen deck of the vibrating screen is displaced in an elliptical movement, with its major longitudinal axis disposed in a direction which is inclined forwardly and upwardly in relation to the screen deck, this movement being obtained by the provision of three transversal shafts, with their shaft end portions rotatively supported in respective pairs of bearings, each pair being housed in a respective bearing case which is, in turn, fixed through a respective sidewall of the vibrating screen, with the geometrical axes of rotation of the eccentric weights arranged at or slightly above the center of gravity of the vibrating screen.

Each end portion of each shaft carries at least one eccentric weight, generally of the same total mass, two shafts being rotated in the same direction, opposite to the direction of rotation of the third shaft, but all with the same frequency and in determined phases, to define the inclination of the major axis of the elliptical movement, the mass difference defining the dimensional relation between the major and minor axes of the elliptical movement.

Although the aforementioned three-shaft constructive solution produces the desired elliptical movement of the screen deck, it requires the provision of the three shafts, each carrying end eccentric weights and the three shafts being synchronized by means of a greater number of gears. This constructive solution results in a heavy mechanical vibrator, of larger dimensions and of relatively higher cost.

In order to simplify the construction of the vibrating screens, it was proposed another constructive solution of mechanical vibrator with only two shafts, but capable of producing, on the screen deck of the vibrating screen, an elliptical displacement, with its major longitudinal axis disposed according to a direction which is inclined forwardly and upwardly in relation to the screen deck this movement being obtained by the provision of two transversal shafts with their shaft end portions rotatively supported on respective bearings housed in respective bearing cases which are in turn, secured through a respective sidewall of the vibrating screen.

Each end portion of each shaft carries at least one eccentric weight with a different mass from that of the other shaft, the two shafts being rotated in opposite directions, with the same frequency and in determined phases, to define the inclination of the major axis of the elliptical movement, the difference of masses of the eccentric weights, between the two shafts, defining the dimensional relation between the major and minor axes of the elliptical movement.

The constructs discussed above can be found in the descriptions and drawings of BR patent documents PI0602585-4 and PI105435-2.

Even though it presents a two-axis construction, lighter and simpler than that of three shafts, imparting to the screen deck of the vibrating screen a more efficient elliptical movement, the third known construction still presents a deficiency common to the other two previous solutions discussed above and which results from the fact that the mechanical vibrator has its bearing cases mounted through medial regions of the opposing sidewalls of the vibrating screen.

With the aforementioned constructions, the mechanical vibrator is mounted inside the structure of the vibrating screen, which makes very complex, time-consuming and costly the disassembling and assembling operations of their components for maintenance. The maintenance operations are generally carried out, as a result of the structural incorporation of the vibrator to the vibrating screen, in highly polluted environments, making these operations even more problematic, requiring undesirable periods of operational interruption of the equipment.

SUMMARY OF THE INVENTION

Due to the drawbacks of mechanical vibrators provided with two or three shafts and mounted through the opposing sidewalls of a vibrating screen, to impart reciprocating or elliptical linear movement to the screen deck of the vibrating screen, the present invention has the objective of providing a mechanical vibrator with a bearing case capable to impart elliptical movement to the screen deck of the vibrating screen and presenting reduced dimensions to only two shafts transversal to the screen and allowing easy and quick assembly and disassembly operations in relation to the structure of the vibrating screen.

As previously mentioned, the mechanical vibrator in question is applied to vibrating screens comprising at least one screen deck defined between two opposing sidewalls, the mechanical vibrator comprising two shafts transversal to the longitudinal axis of the vibrating screen, rotating with the same rotation, in opposite directions and with each of their end portions carrying at least one eccentric weight, said end portions being rotatively supported in bearings supported by the opposing sidewalls of the vibrating screen.

According to the invention, the two shafts have their adjacent end portions supported on bearings mounted on a same bearing case which is removable fixed on beams transversal to the vibrating screen and having opposing ends fixed on the sidewalls of the latter. Each of the end portions of a shaft carries at least one eccentric weight having a total mass different from the total mass of the eccentric weight carried at each of the end portions of the other shaft. The shafts rotate in determined phases, defining the forward and upward inclination, in relation to the screen deck, of the major axis of an elliptical movement imparted to the screen deck.

The construction proposed by the invention allows that the rotation of the two shafts carrying, each one, different weights from that of the other shaft, imparts a desired elliptical movement to the screen deck of the vibrating screen, with the dimensional ratio between the major and minor axes of the elliptical movement being determined by the difference of eccentric mass between the two shafts. In addition, the proposed construction allows the elimination of the fixation of the mechanical vibrator through the sidewalls of the vibrating screen, with the bearings being fixed in respective bearing cases mounted on transversal beams, arranged transversely on the screen, allowing the mechanical vibrator, comprising bearing cases, the bearings and shafts, is easily detachable for maintenance or replacement.

BRIEF DESCRIPTION OF THE DRAWINGS

The invention will now be described with reference to the accompanying drawings, given by way of example of a possible embodiment of the invention and in which.

DETAILED DISCLOSURE OF THE INVENTION

Figure 1:
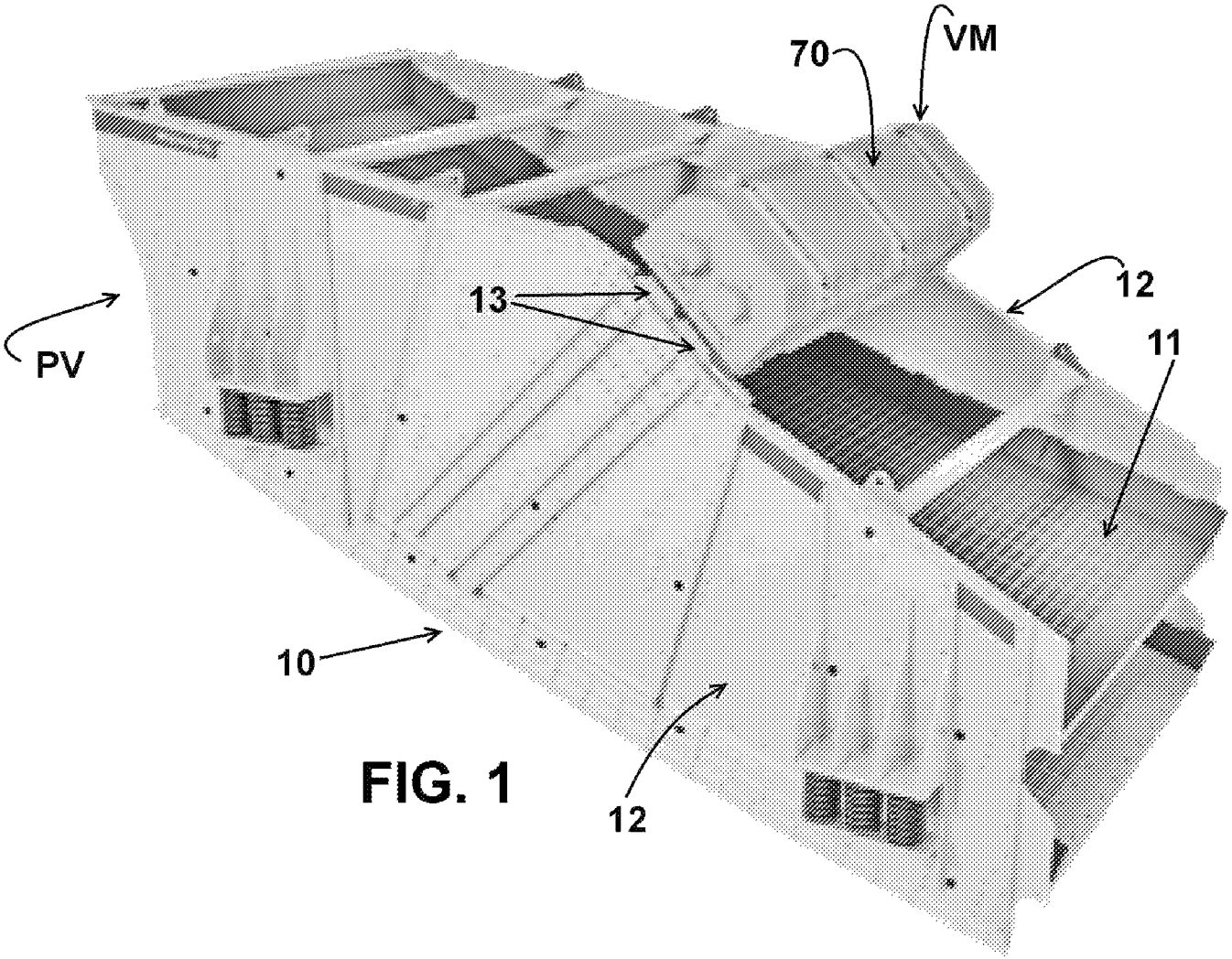
FIG. 1 shows a simplified perspective view of a vibrating screen provided with two screen decks arranged between two sidewalls on which the mechanical vibrator of the invention is removably attached.

As illustrated and already mentioned above, the invention relates generally to vibrating screens PV for sorting bulk material and, more specifically, to those screens of the type comprising at least one screen element 10, generally in the form of an elongated chute and substantially U-shaped profile and having a screen deck 11 onto which is moved a continuous load of bulk material such as various ores, the screen deck 11 being defined between two sidewalls 12 of the vibrating screen PV.

As shown, the mechanical vibrator VM comprises a pair of shafts 20 transversal to the longitudinal axis of the vibrating screen 10, each having an end portion 20*a* carrying at least one eccentric weight 30.

In the illustrated construction, the adjacent end portions 20*a* of the shafts 20 are rotatively supported on bearings 40 which are mounted in a same bearing case 50 which is removably fixed on beams 13, generally two and transversal to the longitudinal axis of the vibrating screen PV. The opposite ends of the beams 13 are fixed to the sidewalls 12 of the vibrating screen PV, generally on the inner face of said sidewalls.

According to the illustrated construction, each bearing case 50 comprises a pair of opposed sidewalls 51, the end portions 20*a* adjacent to each other of the two shafts 20 being each supported on a pair of bearings 40, each bearing 40 being mounted on a sidewall 51 of the respective bearing case 50.

Preferably, each end portion 20*a* of the shafts 20 carries a pair of eccentric weights 30 positioned externally to the respective pair of bearings 40, i.e., externally of the opposite sidewalls 51 of the respective bearing case 50 and which are generally sized to remain internal to the structural case 50.

One of the shafts 20 is driven from any one of the drive units (not illustrated), the end portions 20*a* of the shafts 20 being positioned on each side of the vibrating screen 10, provided with gears 60 which allow the shafts 20 rotating together, with the same rotation, but in opposite directions, as schematically illustrated in FIGS. 3A, 3B, 3C, 3D and 4.

Each of the end portions 20*a* of a shaft 20 carries a gear 60 engaged with a gear 60 carried by the adjacent end portion 20*a* of the other shaft 20, said gears 60 being housed within a same bearing case 50, between the two bearings 40 for supporting the respective end portion 20*a* of the shafts 20.

Figure 3:
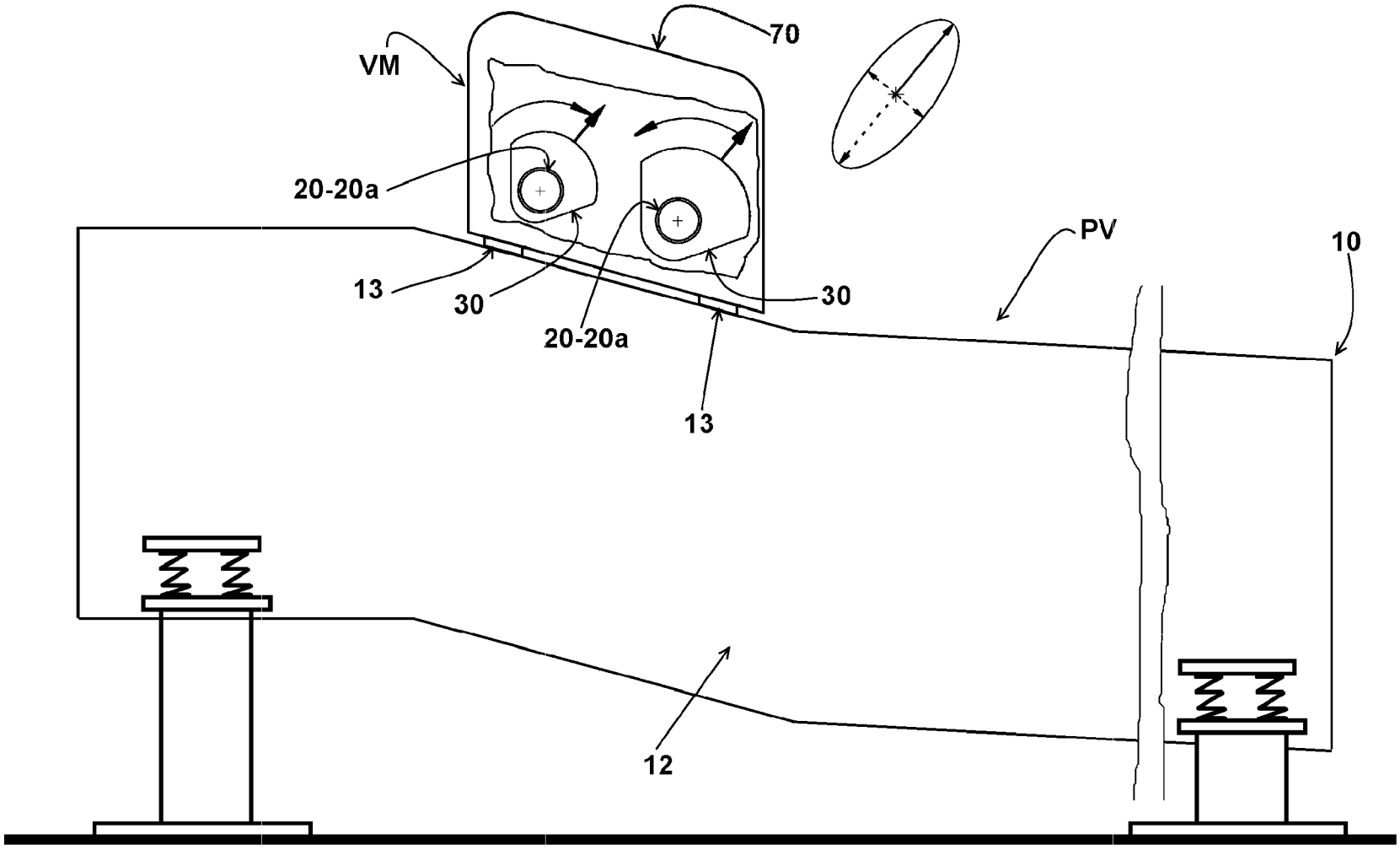
FIG. 3 shows, schematically and in a side view, a vibrating screen with a mechanical vibrator according to the invention, provided with two transversal shafts rotating in opposite directions and at the same frequency, each of which carrying, in its end portions a pair of eccentric weights having a total mass different from that one of the eccentric weights of the other shaft, the eccentric weights being in a first position corresponding to the longitudinal and upward elliptical displacement of the screen deck.

Each of the end portions 20*a* of an shafts 20 carries at least one eccentric weight 30 with a total mass different from that one of the eccentric weight 30 carried by each of the end portions 20*a* of the other shaft 20, said shafts 20, engaged to each other by the gears 60, are rotatively driven in opposite directions at the same frequency and in determined phases to define the forward and upward inclination of the major longitudinal axis of the elliptical movement to be imparted on the screen deck 11 as shown in FIG. 3.

The difference of the masses of the eccentric weights between the two shafts 20 defines the dimensional ratio between the major and minor axes of the elliptical movement of the screen deck 11.

Figure 3A:
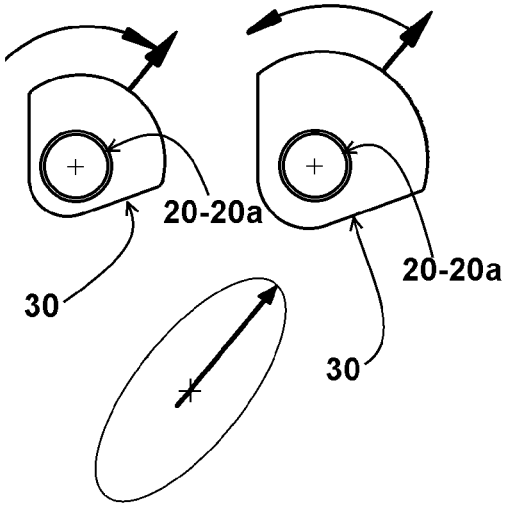
FIG. 3A schematically shows the eccentric weights of the two shafts in the same first upward longitudinal position shown in FIG. 3.
Figure 3B:
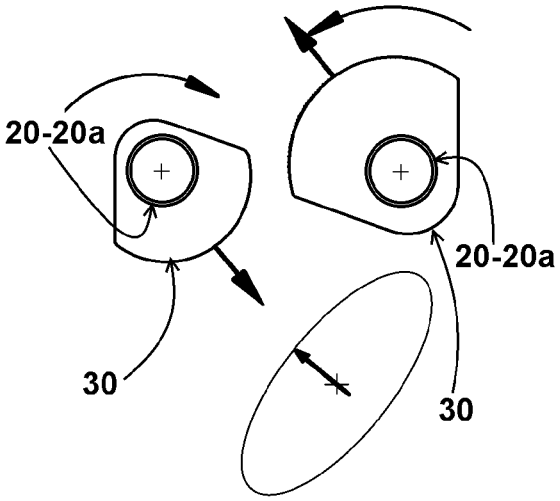
FIGS. 3B, 3C and 3D schematically represent the eccentric weights of the two shafts, at positions representing the other three displacements, transversal upward, longitudinal downward and transversal downward respectively, of the screen deck of the vibrating screen, according to the two axes of the desired elliptical movement.
Figure 3C:
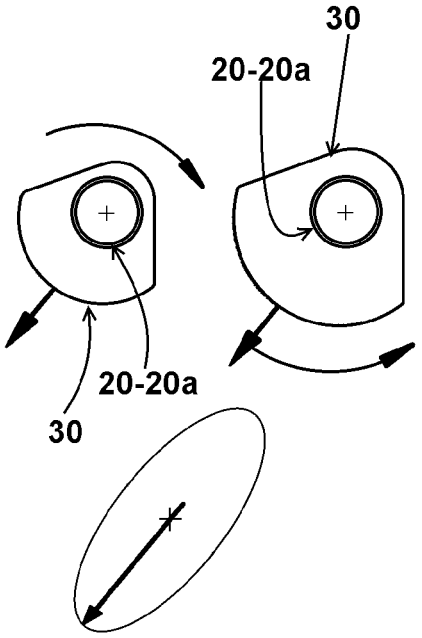
Figure 3D:
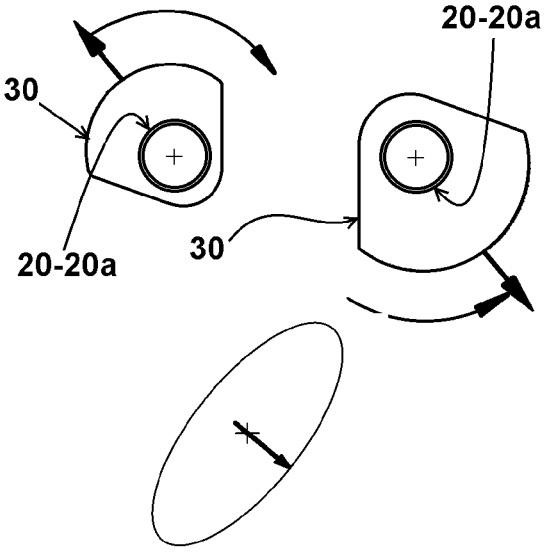
Figure 4:
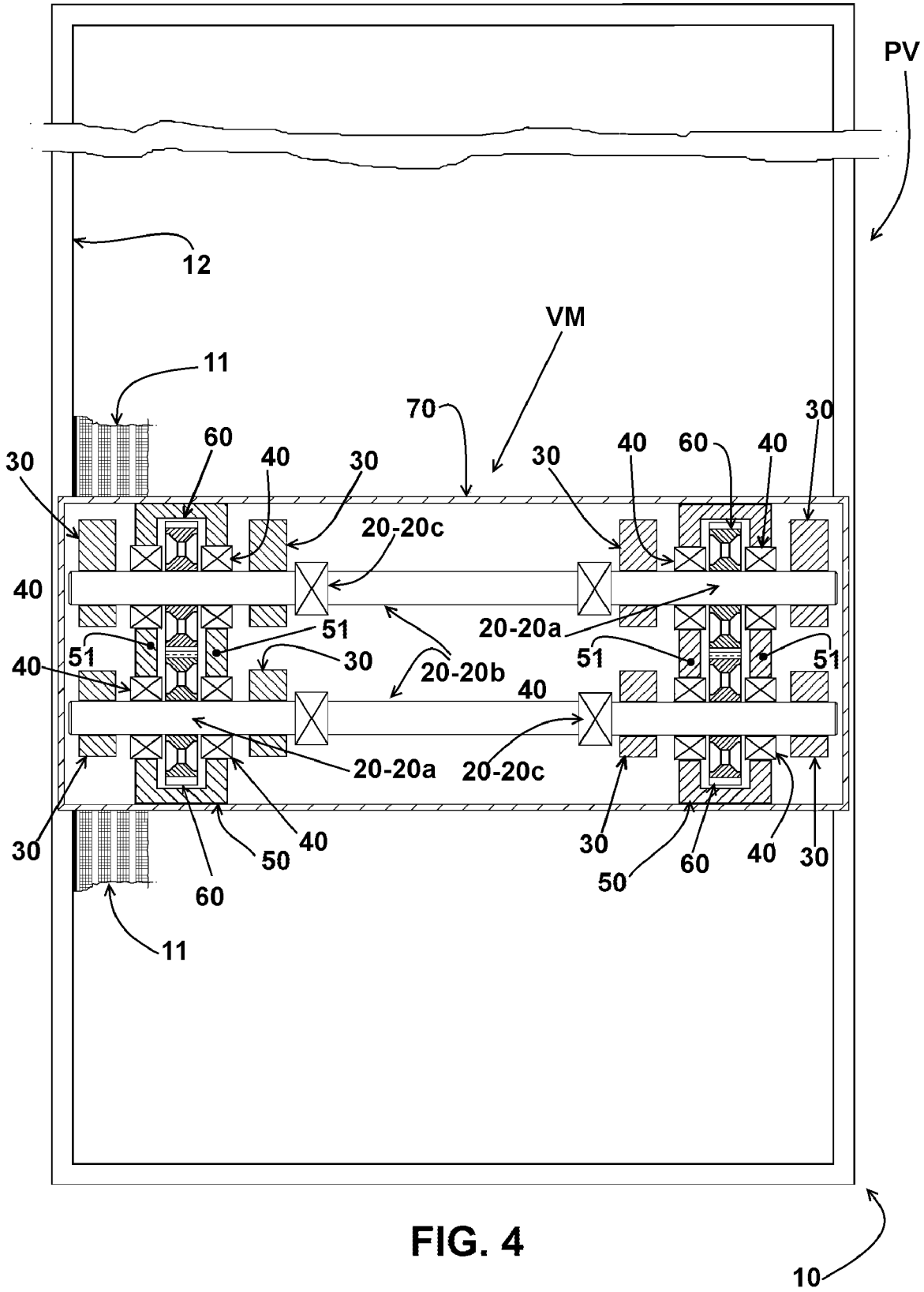
FIG. 4 schematically shows a top plan view of the vibrating screen shown in FIG. 3 and the two transversal shafts of the mechanical vibrator being connected to each other by gears.

FIGS. 3 and 3A show the eccentric weights 30 in a first position corresponding to the elliptical, longitudinal and upward displacement of the screen deck 11, whereas FIGS. 3B, 3C and 3D illustrate the eccentric weights 30, of the two shafts 20, in positions representing the other three transversal displacements, transversal upward, longitudinal downward and transversal downward, respectively, of the screen deck 11 of the vibrating screen 10, according to the two axes of the desired elliptical movement.

In the illustrated construction, each of the two bearing cases 50 is disposed on one side of the vibrating screen PV near to a respective sidewall 12 thereof. With this construction, the end portions 20*a* of each shaft, but preferably of only one of the two shafts 20 defining a drive shaft, are connected to each other by an intermediate portion 20*b* of the respective shaft 20, with the use of flexible couplings 20*c*, suitable and well known in the art.

Figure 2:
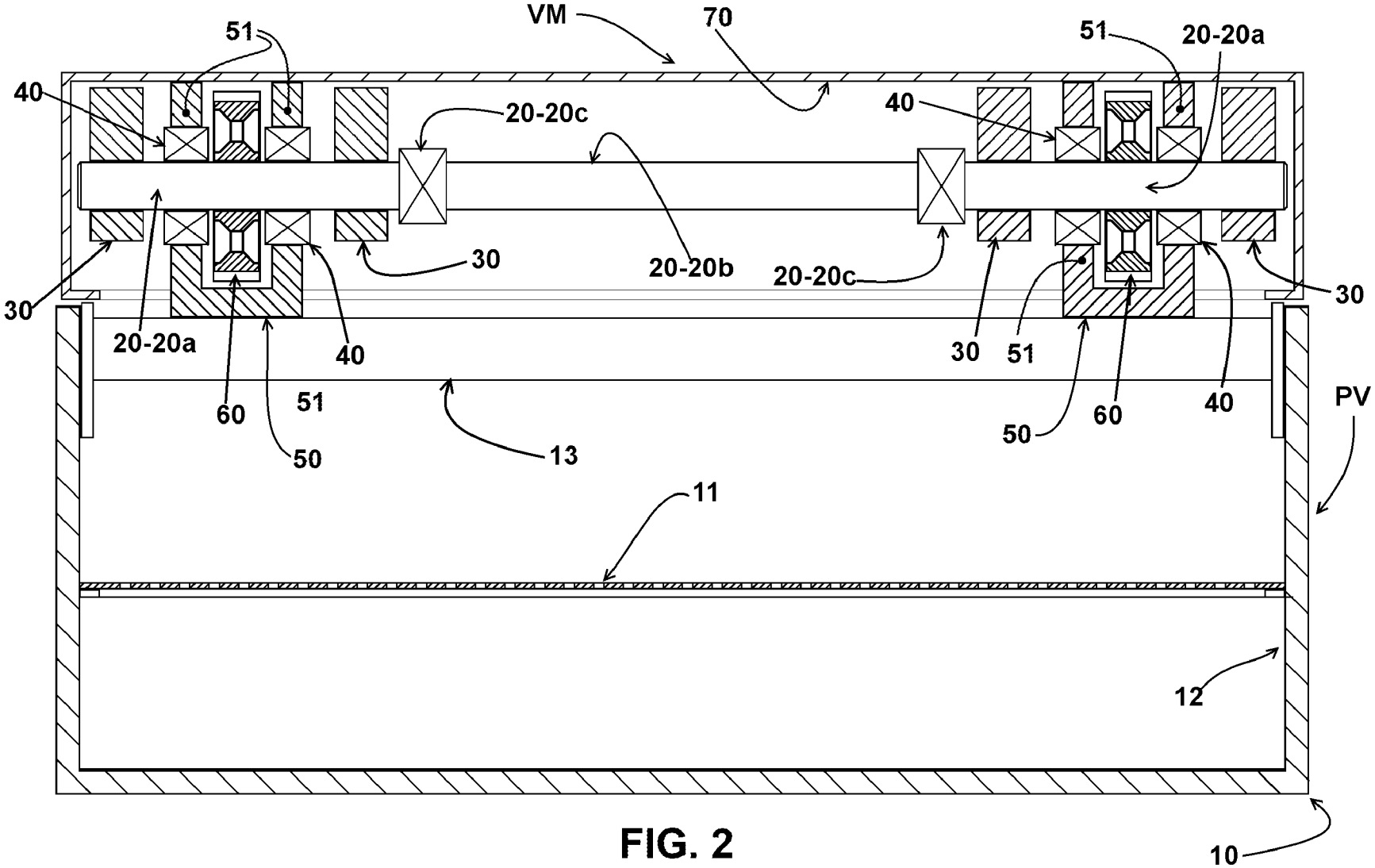
FIG. 2 shows, schematically and simplified, a cross-sectional view of the vibrating screen and the mechanical vibrator shown in FIG. 1.

With the proposed construction, all the constituent elements of the mechanical vibrator VM, comprising the two bearing cases 50 and the shafts 20, are covered by a protective cowl 70 which is removably fixed by any suitable means on the beams as shown in FIGS. 1 and 2.

For the maintenance of the mechanical vibrator VM, it is sufficient that the protective cowl 70 and the bearing cases 50 with the shafts 20 are easily detached from the beams 13, without the need for internal disassembling of the vibrating screen PV.

The proposed construction allows obtaining the elliptical movement of the screen deck 11 by using a mechanical vibrator VM with only two shafts 20 mounted on a pair of bearing cases 50 which are easily and quickly assembled and disassembled from the beams 13 of the vibrating screen PV.

The advantages of this construction are achieved by the assembly of the mechanical vibrator VM displaced well upwardly relative to the center of gravity of the vibrating screen PV, in a longitudinal position relative to the latter, which balances the eccentric, longitudinal and transversal impulses, on the feed and outlet portions of bulk material in relation to the screen deck 11, allowing a substantially constant flow of bulk material from its feed to its outlet of the screen deck 11.

Although only one possible embodiment of the invention has been illustrated, it should be understood that changes in shape, number and relative arrangement of the component parts may be made without departing from the scope of protection defined in the claims accompanying this disclosure.

The invention claimed is:

1. A vibrating screen comprising:

at least one screen deck defined between two screen deck sidewalls, the screen deck configured to support bulk material;

a mechanical vibrator mounted to the screen deck sidewalls and having two transversal shafts which rotate at the same rotation speed and in opposite directions, each shaft having end portions, each end portion carrying at least one eccentric weight;

at least two beams extending transversal to a longitudinal axis of the vibrating screen and each having opposite ends fixed to one of the screen deck sidewalls;

wherein the end portions of the shafts are each supported by a plurality of bearings mounted to one of two bearing cases which are each removably fixed to the beams such that each of the end portions is adjacent to one of the end portions of the other one of the shafts, wherein each of the bearing cases includes a pair of opposite bearing sidewalls and wherein each of the eccentric weights is located externally to the bearing sidewalls;

wherein a total mass of the at least one eccentric weight carried on each end portion of one of the shafts is different than a total mass of the at least one eccentric weight carried on each end portion of the other one of the shafts; and wherein said two shafts rotate in determined phases to impart elliptical movement to the screen deck, the major axis of the elliptical movement having a forward and upward inclination, to transport the bulk material along the screen deck.

2. The vibrating screen of claim 1, wherein the plurality of bearings supporting each end portion includes a pair of bearings with one bearing mounted to each of the opposite sidewalls.

3. The vibrating screen of claim 2, wherein the end portions of each of the shafts carries a gear, and each gear is engaged with the gear carried by the adjacent end portion of the other shaft; and wherein said gears are each housed in the interior of one of the bearing cases between the bearing sidewalls, each gear being housed between the pair of bearings supporting the respective one of the end portions that carries the gear.

4. The vibrating screen of claim 1, wherein the end portions of at least one of the two shafts are configured as drive shafts; and wherein the drive shafts are linked to each other by an intermediate portion of the shaft that extends between the drive shafts, the drive shafts being connected to the intermediate portion by respective flexible couplings.

5. The vibrating screen of claim 1, wherein the mechanical vibrator is mounted above the center of gravity of the vibrating screen and displaced in a longitudinal direction relative to the center of gravity of the vibrating screen, which balances the eccentric, longitudinal and transversal impulses on incoming and outgoing portions of the bulk material in relation to the screen deck.

6. The vibrating screen of claim 1, wherein the two bearing cases and the shafts are covered by a protective cowl removably fixed on the beams.

7. The vibrating screen of claim 1, wherein the bearing cases each include an opening on a top side of the bearing case.

8. The vibrating screen of claim 7, wherein the two bearing cases and the shafts are covered by a protective cowl removably fixed on the beams, wherein the protective cowl covers the openings of the bearing cases and includes a downward facing opening.

* * * * *